US010933680B2

(12) United States Patent
Keeling

(10) Patent No.: US 10,933,680 B2
(45) Date of Patent: Mar. 2, 2021

(54) THREE DIMENSIONAL MAGNETIC ADVENT CALENDAR

(71) Applicant: Hannah Keeling, Hadley, PA (US)

(72) Inventor: Hannah Keeling, Hadley, PA (US)

( * ) Notice: Subject to any disclaimer, the term of this patent is extended or adjusted under 35 U.S.C. 154(b) by 0 days.

(21) Appl. No.: 16/459,281

(22) Filed: Jul. 1, 2019

(65) Prior Publication Data

US 2021/0001657 A1 Jan. 7, 2021

(51) Int. Cl.
*B42D 5/04* (2006.01)
*A47G 33/08* (2006.01)

(52) U.S. Cl.
CPC ..... *B42D 5/04* (2013.01); *A47G 33/08* (2013.01)

(58) Field of Classification Search
CPC ..... B42D 5/04; B42D 5/041; B42D 5/047
See application file for complete search history.

(56) References Cited

U.S. PATENT DOCUMENTS 3,290,812 A * 12/1966 Hunkins ..... B42D 5/047 40/107
3,769,720 A * 11/1973 Terrones ..... G09B 1/08 434/127
3,949,506 A * 4/1976 Benkowski ..... A63B 71/0672 40/711
4,817,320 A * 4/1989 Fraynd ..... G09F 7/04 40/621
5,031,937 A * 7/1991 Nellhaus ..... B42D 1/007 283/48.1
5,269,083 A * 12/1993 Vampatella ..... A47G 1/065 248/206.5
6,186,553 B1 * 2/2001 Phillips ..... B42D 5/04 283/2
6,688,029 B1 * 2/2004 Dunn ..... A47G 1/06 40/711
7,155,851 B2 * 1/2007 Ootsuka ..... A47G 1/12 40/600
8,371,141 B2 * 2/2013 Richmond ..... A44C 25/002 24/303
10,039,393 B1 * 8/2018 Beale ..... B42D 5/047
2003/0163936 A1 * 9/2003 Floss ..... B42D 5/04 40/107
2016/0288560 A1 * 10/2016 Tauber ..... B42D 5/046

* cited by examiner

*Primary Examiner* — Gary C Hoge
(74) *Attorney, Agent, or Firm* — Lyman Moulton, Esq.; Moulton Patents, PLLC

(57) ABSTRACT

A disclosed three-dimensional advent calendar defines multiple predefined advent spaces thereon demarcating an advent. The 3d calendar includes multiple decorated advent objects designed complementary to multiple predefined advent spaces. The 3d calendar also includes an adherent on a back side of the decorated advent objects, the adherent configured to temporarily keep the decorated advent objects proximal a predefined advent space. The adherent includes magnets, hook and loop material and sticky substances. For instance, the 3d calendar includes a Christmas tree, a Disney® Castle, a school graduation diploma, a bag of golf clubs and a baby crib. Exemplary decorated advent objects include Christmas tree ornaments, Mickey Mouse® head shaped objects, school objects, golf clubs, and pacifiers. Similar life milestones and business 3d calendars and matching advent objects are also included. An advent demarcating method via the 3d calendar and decorated advent objects is further included in the disclosure.

13 Claims, 3 Drawing Sheets

THREE DIMENSIONAL MAGNETIC ADVENT CALENDAR

SUMMARY OF THE INVENTION

A disclosed three-dimensional advent calendar defines multiple predefined advent spaces thereon demarcating an advent. The 3d calendar includes multiple decorated advent objects designed complementary to multiple predefined advent spaces. The 3d calendar also includes an adherent on a back side of the decorated advent objects, the adherent configured to temporarily keep the decorated advent objects proximal a predefined advent space. The adherent includes magnets, hook and loop material and sticky substances. For instance, the 3d calendar includes a Christmas tree, a Disney® Castle, a school graduation diploma, a bag of golf clubs and a baby crib. Exemplary decorated advent objects include Christmas tree ornaments, Mickey Mouse® head shaped objects, school objects, golf clubs, and pacifiers. Similar life milestones and business goals 3d calendars and matching advent objects are also included. An advent demarcating method via the 3d calendar and decorated advent objects is further included in the disclosure.

Other aspects and advantages of embodiments of the disclosure will become apparent from the following detailed description, taken in conjunction with the accompanying drawings, illustrated by way of example of the principles of the disclosure.

Figure 1:
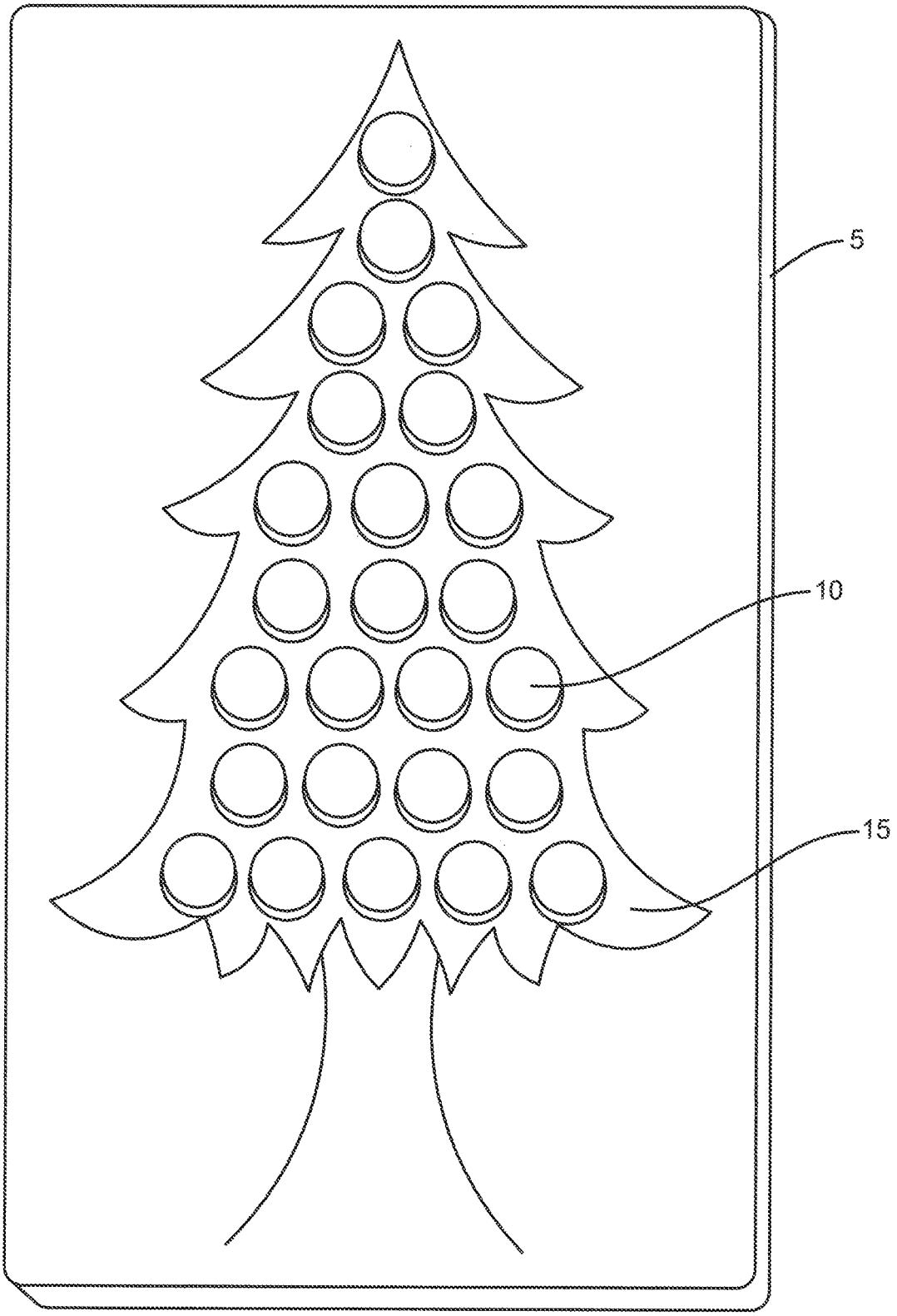
FIG. 1 is a depiction of a three-dimensional calendar with predefined advent spaces and decorated advent objects in accordance with an embodiment of the present disclosure.

Throughout the description, same reference numbers may be used to identify same or similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Dimensions detailed herein and in the drawings are intended to be a guide to nominal manufacturing dimensions. The detailed dimensions may vary by plus or minus ten percent taking into account manufacturing restraints and materials for various embodiments as recited, taught and suggested herein. The dimensions therefore are applicable to at least one embodiment but are not meant to be limiting to other embodiments of the disclosure.

The disclosed magnetic photo countdown calendar hangs on the wall in a home, school, or business and serves as a customized, personalized countdown to some anticipated event. Customers upload their personal photos which are then made into "ornaments"—one for each day, week, or month of the countdown—to be hung via magnets on the calendar.

The disclosed magnetic advent calendar is best made of metal to attract the magnets but is also made of metallic flat stock. The calendar can be reused year after year with the customer returning to the company repeatedly to have new ornaments made.

Here are some examples: "Grandma and Grandpa's Advent Calendar" Each day of the month of December, Grandma and Grandpa pull a photo ornament out of the box they received and place it on their Christmas tree calendar—24 ornaments for each day of December leading up to Christmas. The calendar is a gift from a daughter who chooses 24 of the best photos of the grandkids from that year. It's now an annual tradition. The daughter has new ornaments made for them each year, and the Grandparents not only love pulling out a new photo of the grandkids every day, but also love showing it off to everyone who visits for Christmas.

In an embodiment of the disclosure is a "Countdown to Disney" implementation. To surprise the kids with a trip to Disney World, Mom and Dad presented them with this customized countdown calendar. The calendar background is Cinderella's castle, and there are 12 Mickey-head-shaped ornaments to mark each week left until the trip. On each ornament is a different photo from the family's last trip to Disney. The kids are so excited about their trip and love to pull a new ornament out each week to hang on the castle. They love reminiscing about their last trip and they love knowing they are one week closer to being at the most magical place on earth.

"Countdown to Baby"—A young couple is thrilled to learn that they are expecting. They purchase a calendar with 9 ornaments to countdown the months until Baby arrives. They thoughtfully chose significant photos from everyday life—photos of family members, one of the beloved pet, one of the house where they are living, and several of them together as a couple. The couple hang the calendar in the nursery so that after they've completed the countdown, Baby can grow up seeing photos of the important things in his life.

"Countdown to Summer"—During the last month of school, an elementary school teacher hangs a countdown calendar in her classroom. Each day at morning meeting, the kids excitedly pull out a photo that had been taken at some point that year. They remember the fun things that they did and learned that year as they look forward to summer vacation. The teacher pulls the calendar out every year and has new photos made for that year's class.

"Countdown to Retirement"—When he announces that he is retiring at the end of the year, coworkers go together to gift the retiree with this countdown calendar. It features photos commemorating his years at the office. He is thankful for the wonderful memories that these photo ornament bring to mind, and he is excited to begin this next chapter of life.

FIG. 1 is a depiction of a three-dimensional calendar with predefined advent spaces and decorated advent objects in accordance with an embodiment of the present disclosure.

The depiction includes a 3d calendar on a metallic substrate 5, multiple advent spaces and complementary multiple decorated advent objects 10 and an advent calendar subject 15. The depicted 3d calendar is constructed on a metallic substrate 5 and the decorated advent objects have magnets on a surface thereof (not depicted) or are magnets themselves in embodiments. The depicted 3d calendar is a Christmas tree in the embodiment but is also other advent demarcating subjects according to holidays, birthdays, life milestones, family events and business events.

Figure 2:
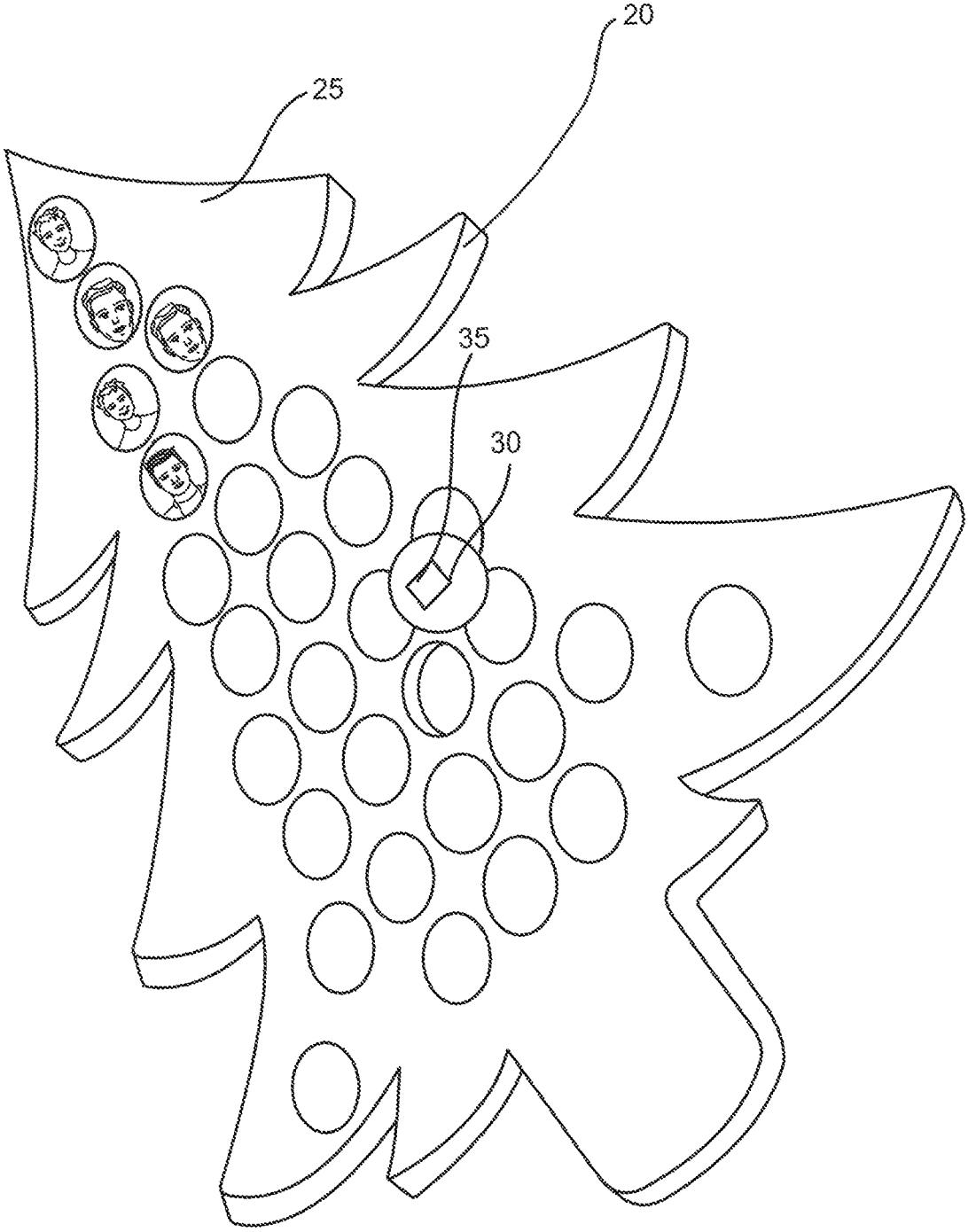
FIG. 2 is a depiction of a three-dimensional Christmas Tree calendar with predefined advent spaces and embedded decorated advent ornaments in accordance with an embodiment of the present disclosure.

FIG. 2 is a depiction of a three-dimensional Christmas Tree calendar with predefined advent spaces and embedded decorated advent ornaments in accordance with an embodiment of the present disclosure. The depiction includes a calendar metallic substrate 20, multiple advent spaces and complementary multiple decorated advent objects 30 embedded in the advent spaces, an adherent 35 such as a magnet thereon and an advent 3d calendar subject 25 which in this case is also a Christmas tree.

Figure 3:
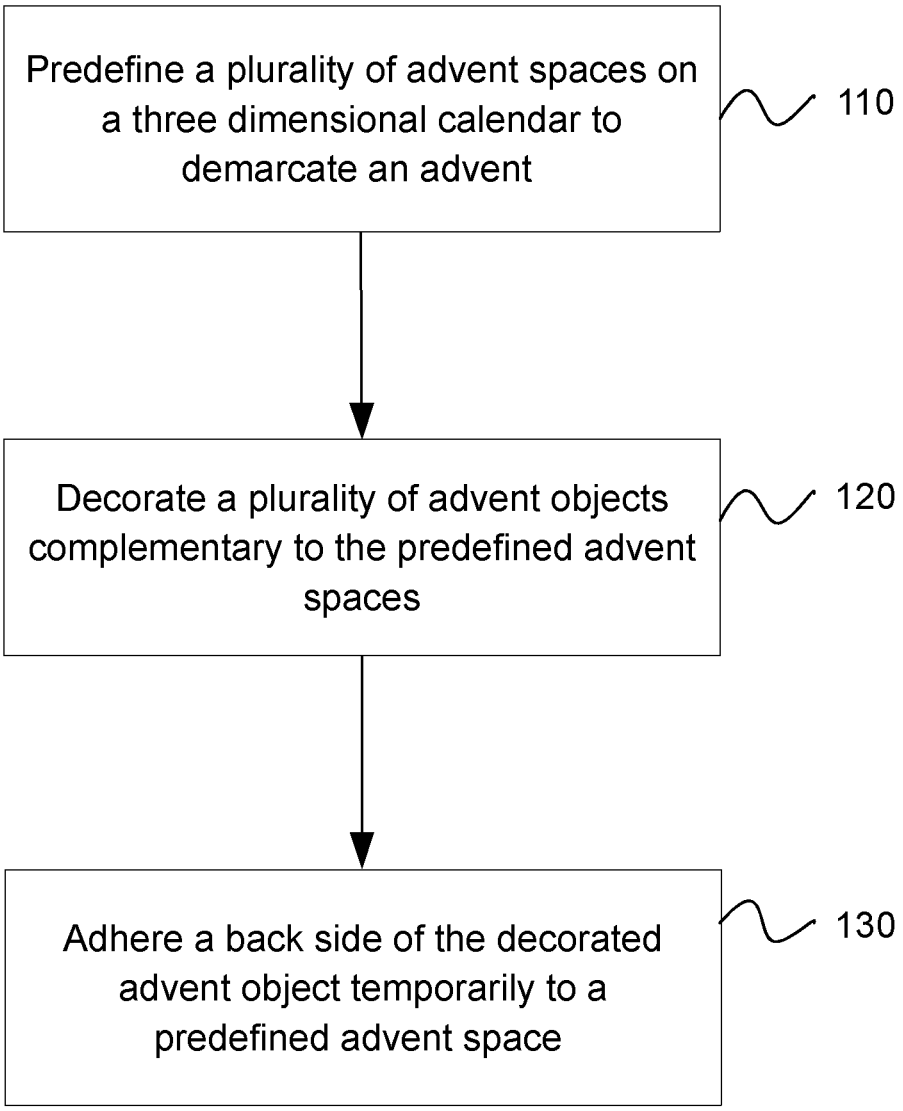
FIG. 3 is a flow chart depiction of a method for demarcating an advent via the 3d calendar with predefined advent spaces and decorated advent objects in accordance with an embodiment of the present disclosure.

FIG. 3 is a flow chart depiction of a method for demarcating an advent via the 3d calendar with predefined advent spaces and decorated advent objects in accordance with an embodiment of the present disclosure. The depicted method includes predefining 110 multiple advents spaces on a three dimensional calendar to demarcate an advent. The method also includes decorating 120 multiple advent objects complementary to the predefined advent spaces. The method further includes adhering 130 a back side of the decorated advent objects temporarily to a predefined advent space.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. An advent calendar, comprising:

a three dimensional calendar having a metallic substrate and configured to define a plurality of predefined advent spaces thereon demarcating a successively increasing number of advents from a first end of the calendar to a second end thereof having a larger surface area than the first end and an increasing surface area there between proportional to the increasing number of advents;

a plurality of decorated advent objects configured complementary to the plurality of predefined advent spaces;

an adherent on a back side of the decorated advent objects, the adherent configured to temporarily keep the decorated advent objects proximal a predefined advent space.

2. The advent calendar of claim 1, wherein the three dimensional calendar is a Christmas tree.

3. The advent calendar of claim 1, wherein the three dimensional calendar is a family genealogy tree.

4. The advent calendar of claim 1, wherein the decorated advent object is a Christmas tree ornament.

5. The advent calendar of claim 1, wherein the decorated advent object is a picture ornament.

6. The advent calendar of claim 1, wherein the adherent is a magnet.

7. The advent calendar of claim 1, wherein the adherent is a hook and loop material.

8. The advent calendar of claim 1, wherein the adherent is a sticky substance.

9. An advent calendar, comprising:

a three dimensional calendar having a metallic substrate and configured to define a plurality of predefined advent spaces thereon demarcating a successively increasing number of advents from a first end of the calendar to a second end thereof having a larger surface area than the first end and an increasing surface area there between proportional to the increasing number of advents;

a plurality of decorated advent objects configured complementary to the plurality of predefined advent spaces;

a first adherent on a back side of the decorated advent objects; and a second adherent on a front side of the predefined advent spaces, wherein the adherents are configured to temporarily keep the decorated advent objects and a predefined advent space proximal one another.

10. The advent calendar of claim 9, wherein the first adherent is a hook material and the second adherent is a loop material.

11. The advent calendar of claim 9, wherein the first adherent is a magnet and the second adherent is also a magnet.

12. An advent calendar method, comprising:

defining a plurality of predefined advent spaces on a three dimensional calendar having a metallic substrate and to demarcate a successively increasing number of advents from a first end of the calendar to a second end thereof having, a larger surface area than the first end and an increasing surface area there between proportional to the increasing number of advents;

decorating a plurality of advent objects configured complementary to the plurality of predefined advent spaces; and adhering a back side of the decorated advent objects temporarily to a predefined advent space.

13. The advent calendar method of claim 12, further comprising embedding the advent objects into the three dimensional calendar at the predefined advent spaces.

* * * * *